United States Patent [19]

Brown

[11] 4,183,233

[45] Jan. 15, 1980

[54] APPARATUS FOR FLUID TREATMENT OF TEXTILES

[75] Inventor: Jerald E. Brown, Jasper, Ga.

[73] Assignee: Simon Klebanow, Greenwich, Conn.

[21] Appl. No.: 895,507

[22] Filed: Apr. 11, 1978

Related U.S. Application Data

[63] Continuation-in-part of Ser. No. 792,721, May 2, 1977, abandoned.

[51] Int. Cl.[2] ..... D06B 5/20

[52] U.S. Cl. ..... 68/5 C; 68/43; 68/194; 68/196; 68/207

[58] Field of Search ..... 68/187, 189, 194, 196, 68/201, 5 C, 8, 188, 207, 43

[56] References Cited

U.S. PATENT DOCUMENTS

| | | | |
|---|---|---|---|
| 1,060,277 | 4/1913 | Murray | 68/189 |
| 1,367,112 | 2/1921 | Ashworth | 68/187 |
| 2,779,977 | 2/1957 | Wilkie | 68/189 X |
| 3,914,962 | 10/1975 | Doire et al. | 68/187 X |

FOREIGN PATENT DOCUMENTS

| | | | |
|---|---|---|---|
| 612448 | 7/1926 | France | 68/189 |

*Primary Examiner*—Philip R. Coe

*Attorney, Agent, or Firm*—Kane, Dalsimer, Kane, Sullivan and Kurucz

[57] ABSTRACT

The disclosure is of apparatus and its use to treat textiles with fluids such as dyes, resist chemicals and like agents. The apparatus is particularly useful for space-dyeing textiles such as skeins of textile yarn. The apparatus comprises an enclosure having an opening and defining a treatment chamber, a closure, means for introducing predetermined measures of the treating agent and means for compressing the textile within the treatment chamber. By the method of the invention, textiles are disposed in the treatment chamber and compressed. While compressed, the fluid agent is uniformly dispersed under pressure in portions of the interior of the body of the compressed yarn and in a proportion just sufficient to effect the desired treatment. The apparatus and method of the invention are more efficient than prior art methods and apparatus, reduce water requirements and reduce the potentially undesirable impact of a textile treating process on the environment.

9 Claims, 17 Drawing Figures

APPARATUS FOR FLUID TREATMENT OF TEXTILES

CROSS-REFERENCE TO RELATED APPLICATION

This application is a continuation-in-part of copending application Ser. No. 792,721 filed May 2, 1977, and now abandoned.

BACKGROUND OF THE INVENTION

1. Field of the Invention

The invention relates to the treatment of textiles with fluid treating agents and particularly relates to apparatus for treating discontinuous segments of continuous textile yarns with such agents.

2. Brief Description of the Prior Art

The present invention comprises apparatus which is particularly advantageous when applied to the space-dyeing of textile yarns, particularly carpet grade yarns. U.S. Pat. No. 3,926,547 presents a comprehensive review of the prior art as of 1974 in the following words. "There are several known processes for producing space dyed yarn for use in fabricating multi-colored fabrics. One common process of this type is called the 'knit de knit' process, and includes the steps of knitting the yarn into a knitted prefabric, applying stripes or other patterns of dye on the fabric by a printing operation, heat setting the dye, and then unraveling the fabric to produce a space dyed yarn. The heat setting operation tends to set permanent kinks or curls in the yarn due to the loops produced in knitting, and it is common to attempt to subsequently remove these kinks by various processes such as running the kinked yarn over a series of corners. A typical process of this type is further described in the U.S. Patents to Whitaker et al., U.S. Pat. Nos. 3,012,303 and 3,102,322.

"Even where attempts are made to remove as many of the kinks and curls as possible from 'knit de knit' yarn, the resulting yarn nevertheless possesses a considerable amount of kinking, and such kinking is unsuitable in many applications such as where long shag or plush carpets are to be constructed from the yarn. Further, the attempts to remove the kink tend to draw out the yarn, and thus a considerable portion of the bulk or covering ability of the yarn is lost.

"One further disadvantage of the 'knit de knit' process is the fact that the colors are applied by a printing operation, and such operation by its very nature is unable to achieve thorough penetration of the dye into the yarn. Also, when certain yarns such as nylon are printed, true colors are not achieved due to a 'frosting' or 'halo' effect which is caused by the printing mechanism.

"Another commonly employed process for producing space dyed yarns involves passing a large number (or warp) of yarns in a parallel arrangement through a series of dye applicators that are charged with dyes of different colors. As the warp of yarns passes through the machine, predetermined portions are pressed into contact with selected applicators to achieve the desired space printing. The yarns are then steamed to fix the dye. A typical process of this type is disclosed in the U.S. Patent to Farrer et al., U.S. Pat. No. 3,503,232.

"While the warp printing operation achieves a straight, non-kinked yarn which is desirable for plush or shag type constructions, the fact that considerable stress is placed on the yarns during the printing and steaming operations results in a significant loss of bulk which cannot be recovered. Also, since a dye printing operation is involved, deep penetration of dye into the yarn cannot be achieved.

"It has also been proposed to employ a skein dyeing process for producing space dyed yarns. In the process as presently practiced, the skeins are initially heated in a dry heating apparatus or autoclave to bulk and heat set the yarns, and the skeins are then mounted on a rack and completely immersed in a liquid dye bath which contains a dyestuff adapted to apply the lightest shade of the color selection involved. The temperature of the dye bath when the skeins are immersed is necessarily relatively low, for example about 120° F., and the temperature must then be gradually increased at a rate of about 2° per minute to the boiling temperature, which is about 220° F. It is not possible to immerse the skeins in a bath having a temperature above about 120° F., since at an elevated temperature the dye will tend to 'jump on' the yarn when it is immersed and thus the dye will not be applied evenly.

"After reaching the boiling temperature, the skeins are held immersed for about ten minutes to exhaust the dyestuff. The bath is then dropped, the skeins lifted, and a fresh load of water is run into the vat and its temperature adjusted to about 120° F. A second dyestuff is then added which when overdyed on the previously dyed yarns will give the desired color of the next darkest shade. The skeins are partially immersed in the second bath, and the temperature again slowly raised to the boiling temperature and held for another ten minutes to exhaust the dyestuff. The above procedures are repeated for the third and any subsequent dyeing operations, differing only in that each subsequent skein immersion is less than in the preceding operation.

"It is recognized that skein dyeing is able to achieve deep, bright colors in the dyed yarns, this advantage arising from the fact that skein dyeing takes place under optimum conditions of time, temperature, and dye exhaustion which cannot be achieved in a printing operation. Also, skein dyeing results in a high bulk which arises from the relaxed, tension free conditions which exist while the yarn is in skein form and being dyed.

"While the skein dyeing process as presently practiced possesses the above recognized advantages, skein dyeing has not been extensively employed since as presently practiced it produces a similar 'long space' repeating color pattern on all of the yarns which has a tendency to produce streaks or 'chevrons' on the face of the finished pile fabric. More particularly, where such a repeating color pattern is present on the yarns, the colors of adjacent yarns in the finished fabric tend to get into and out of phase in a regular sequence and this produces visible streaks. Such streaks are not as pronounced where a 'short space' color pattern is achieved, and such 'short space' pattern is easily produced by the above dye printing operations. Also, as will be apparent from the above description, the skein dyeing process as presently practiced has a very low production rate as compared to that of the printing processes. Thus while skein dyeing possesses recognized advantages, it has not found commercial acceptance because of these overriding disadvantages."

The patentees in the U.S. Pat. No. 3,926,547 proposed to solve some of the prior art problems associated with skein dyeing by a method and apparatus wherein a bank of skeins is initially immersed in a heated aqueous bath to bulk and heat set the yarns. The bank is then removed from the aqueous bath and a dyestuff is added thereto so that a first dye bath is formed from the aqueous bath. The bank is then completely immersed in the first dye bath to apply a first color to the entire skeins, and the bank is maintained therein until the dye bath is substantially exhausted. The bank is then lifted from the exhausted first dye bath and a second dyestuff is added to the exhausted first dye bath to form a second dye bath adapted to color the yarn a second predetermined color. The bank is then partially immersed in the second dye bath so that the second dye bath acts to color only the immersed portions of the skeins. In order to achieve a varying color pattern on the skeins, provision is made for tilting the bank of skeins so that some of the skeins are further immersed than others.

If it is desired to apply a third color to the skeins, the bank is again lifted and a third dyestuff is added to the exhausted dye bath, and the bank is then again partially immersed in the third dye bath to a level less than the skeins were immersed in the second dye bath. To further vary the color patterns of the skeins, the bank may be tilted into a somewhat different orientation than was the case when the bank was partially immersed in the second dye bath. The above procedure may be repeated for applying additional colors to the yarns if so desired.

Other U.S. patents representative of the state of the art are U.S. Pat. Nos. 3,120,422; 3,671,180; and 3,926,547.

In general, the prior art apparatus and methods for space dyeing, particularly of skeins, require lengthy periods to complete a single cycle of operation. Several hours may be required for the repetition of skein dippings into multiple dye baths. It may even be necessary to transfer skeins from first baths to subsequent baths. The lengthy procedures are energy consuming, often requiring long periods of exposure of the yarns to elevated temperatures and the maintenance of treating or dyeing baths at elevated temperatures. Further the prior art apparatus and methods generally require large volumes of rinse waters, etc., creating problems of waste water disposal without polluting the environment.

The apparatus of my invention is advantageous in that quality treatment of yarns with fluid treating agents such as dyes may be obtained employing minimal quantities of energy and water. Fuel is conserved. Waste water treatment is minimized. Process time is reduced from hours to a few minutes, giving rise to greater production throughput. In all, greater efficiency of production is obtained without kinking, loss of bulk, streaking or creation of "chevrons". Even dyeing with deep penetration of the yarn is obtained. By the use of the apparatus of the invention, discernible patterning of space-dyed yarns is avoided.

SUMMARY OF THE INVENTION

The invention comprises apparatus for the treatment of textiles with a fluid, which comprises;

an enclosure having a wall defining an interior treatment chamber for receiving the textiles and having an opening therein providing access to the chamber;

a removable closure for the opening;

means associated with the enclosure for compressing textiles received in the treatment chamber, into a compression zone of the chamber;

conduit means having a first open end outside of the enclosure and a second open end at a point within the compression zone and spaced from the enclosure wall; and means for metering and delivery of treating fluid to the second open end of the conduit means, in a proportion which will be fully absorbed in a predetermined area of the textile compressed in the chamber.

The term "bundle" or "loose bundle" as used throughout the specification and claims means any form of textile arrangement wherein the textile yarn or lengths of yarns are arranged with portions or lengths arrayed substantially parallel to each other such as is found in skeins, hanks, ropes or sheets of yarn or yarns. Outside the scope of the term are, for example, packages of wound yarn, which are not loose.

DETAILED DESCRIPTION OF THE PREFERRED EMBODIMENTS OF THE INVENTION

Those skilled in the art will readily gain an appreciation of the invention from the following description of the preferred embodiments, when read in conjunction with the accompanying drawings of FIGS. 1 through 17, inclusive.

Figure 1:
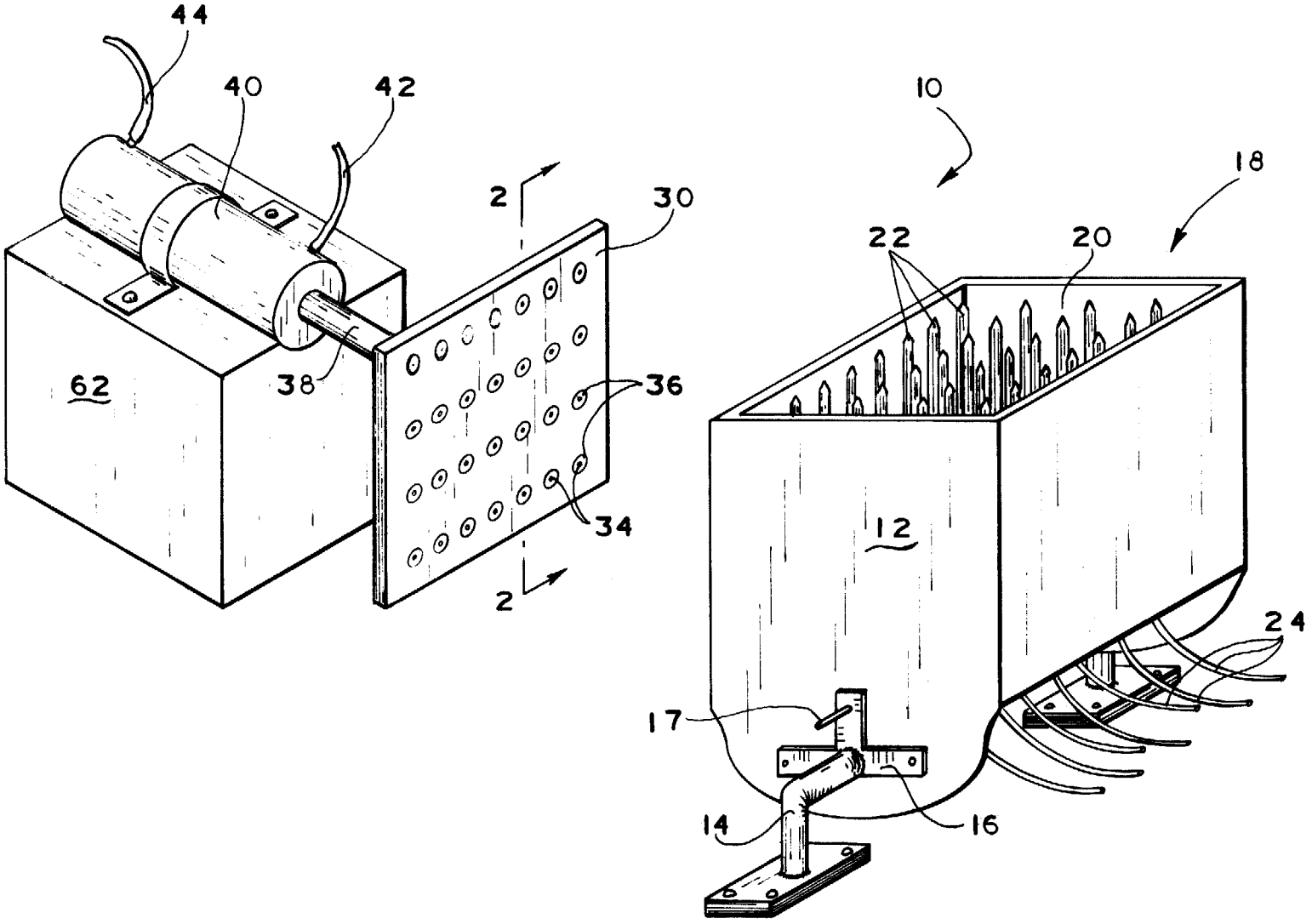
FIG. 1 is an isometric view of embodiment apparatus of the invention.

FIG. 1 is an isometric view of a preferred embodiment apparatus 10 for carrying out the treatment of textiles with a fluid agent. The apparatus 10 comprises a box-like enclosure 12 pivotally supported on stanchion 14 by trunnion 16. As shown in FIG. 1, removable pin 17 locks enclosure 12 in an upright position by engagement with a female fitting (not seen). The enclosure 12 has an open upper end 18 providing access to an interior treating chamber 20. Projecting into chamber 20 from the enclosure 12 bottom are a plurality of spray tubes 22 which are dispersed throughout the chamber 20. The spray tubes 22 are mounted in the floor of enclosure 12. Fluid supply lines 24 connect with spray tubes 22 through the bottom of enclosure 12 (connection not seen in FIG. 1). A component part of the apparatus 10 is a closure 30 which is adapted to mate with enclosure 12 and close opening 18. The closure 30 is pierced by apertures 34 which are axially aligned with and receive the upper ends of spray tubes 22 when the closure member 30 is placed in opening 18 of enclosure 12. The apertures 34 are defined by annular gasket members 36 which insure a sliding seal between the closure member 30 and the upper ends of inserted spray tubes 22 to prevent leakage as will be described hereinafter. The gasket members 36 are secured in the body of closure 30 by a frictional fit.

As shown in FIG. 1, the closure member 30 is mounted on ram 38 which is movably actuated in a horizontal plane by piston 40. Piston 40 may be a hydraulically, mechanically or pneumatically activated piston-cylinder. The preferred piston 40 shown is mounted on a secure block 62 and is operated by fluid supply line 44 and fluid exhaust line 42.

Figure 2:
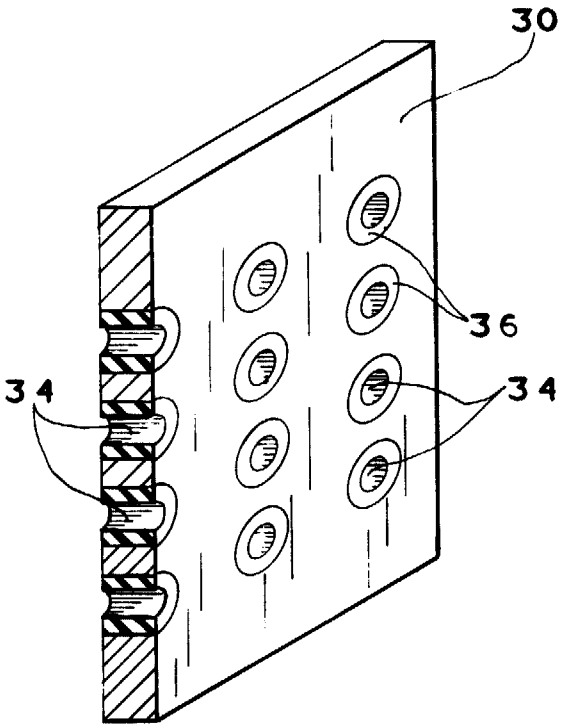
FIG. 2 is a cross-sectional side view (angled) along lines 2—2 of FIG. 1.

Referring to FIG. 2, a cross-sectional side view (angled) of the closure member 30 along lines 2—2 of FIG. 1, one may see further details of the closure member 30. During operation, treating fluid is delivered to spray tubes 22 under pressure. The gaskets 36 prevent the fluids from passing through the closure 30 where the spray tubes 22 may penetrate.

Figure 3:
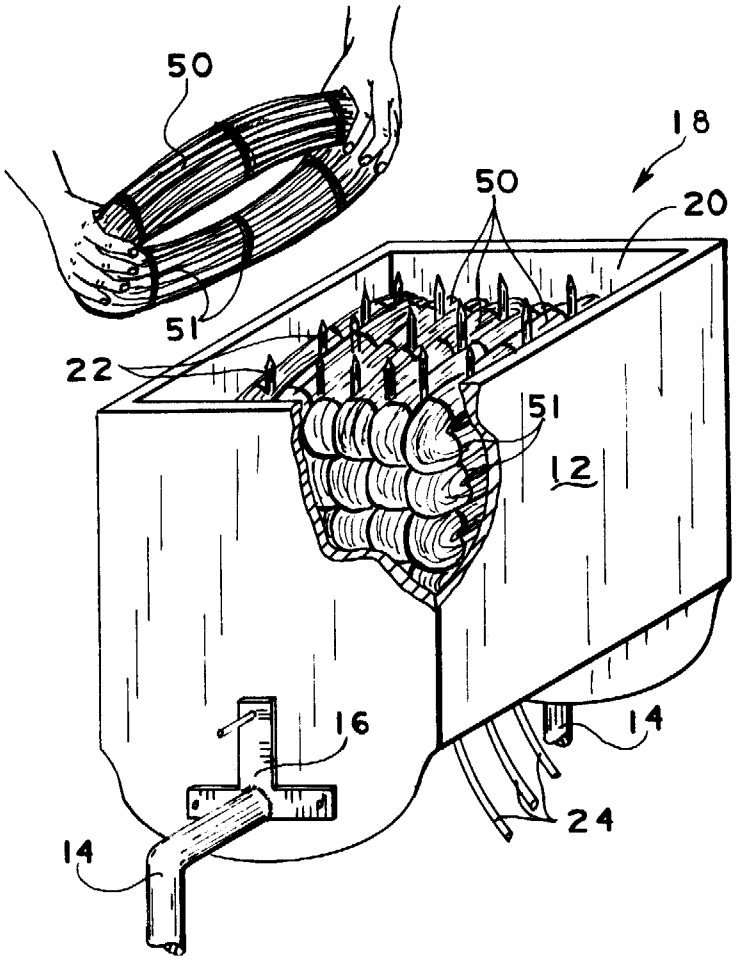
FIG. 3 shows the loading of the embodiment apparatus of FIG. 1, with skeins of textile yarn.
Figure 4:
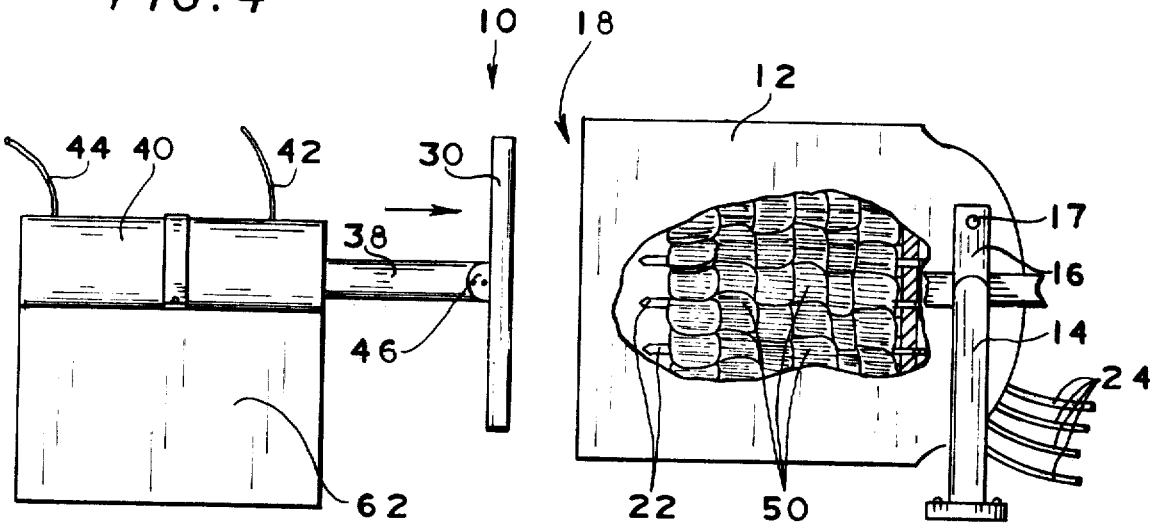
FIG. 4 is a side elevation, cross-section-in-part, of the embodiment apparatus of FIG. 1 after loading but before closure.

In operation of the apparatus 10 the initial step is to provide the textiles to be treated in the form of loose bundles such as skeins 50 as shown in FIG. 3. As shown, the skeins 50 have been tied at periodic intervals with ties 51 as a convenience in handling the skeins 50. Ties 51 are not an essential. It is also not necessary that yarns be wound in a skein. Alternatively, for example, a bundle of loose ends of yarns may be disposed in the chamber 20, provided the lengths of yarns are substantially aligned as shown in FIG. 3. The skeins of textile yarn 50 (or loose ends) are positioned in the chamber 20 of enclosure 12 so that the yarn length is at a 90° angle to the spray tubes 22. This is important for uniform results. The skeins 50 are also positioned so that the individual length of yarns are dispersed evenly amongst the spray tubes 22 as shown in FIG. 3. The chamber 20 is thus substantially filled with a number of skeins 50 placed one on top of the other and in side-by-side array to substantially fill the chamber 20 uniformly. With the enclosure 12 initially loaded as described above, the enclosure 12 is pivoted as shown in FIG. 4. FIG. 4 is a cross-sectional, in part, side elevation of the embodiment apparatus 10 shown in FIG. 1 after loading. As shown in FIG. 4, the enclosure 12 has been pivoted towards closure member 30 so that the spray tubes 22 are horizontally aligned (the apertures 66, described hereinafter, are thus directed on a vertical plane). In this position, the piston 40 mounted on mount 62 is actuated so that ram 38 moves closure 30 in place to close opening 18 as seen in FIG. 5.

Figure 5:
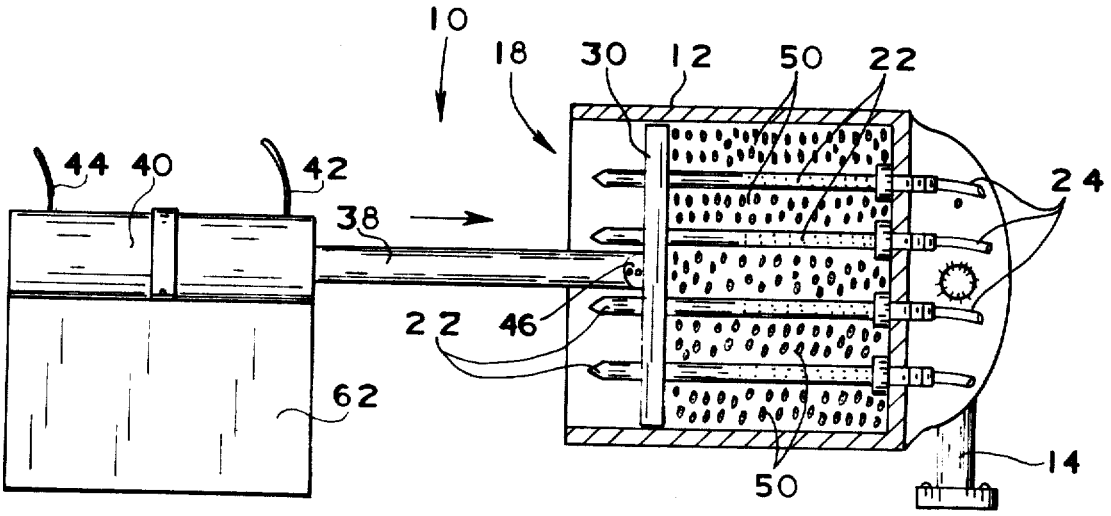
FIG. 5 is a cross-section-in-part side elevation of the embodiment apparatus shown in FIG. 4, but after closure.

FIG. 5 is a cross-sectional, in part, side elevation of the embodiment apparatus 10 seen in FIG. 4 but with the closure member 30 in place closing opening 18 of enclosure 12. As can be seen, the ram 38 activated by piston 40 forces closure member 30 into the opening 18 of enclosure 12 and continues movement towards the bottom of enclosure 12 so as to compress the loaded skeins 50. The free ends of spray tubes 22 protrude through the apertures 34 of closure 30 and are sealed to the closure member 30 by rubber gaskets 36. Thus, the chamber 20 of enclosure 12 confines the skeins of yarn 50 under uniform compression. According to the method of the invention, the skeins 50 are compressed under a weight within the range of from about 5 to about 50 pounds/sq. inch, preferably 15 to about 20 pounds/sq. inch. The closure member 30 may be moved in any distance (within the limits of the desired compression) into the chamber 20, stopped only by the volume of skeins of yarn 50 therein. Thus, the volume of chamber 20 is variable depending on the fill of skeins 50 therein and the degree of skein compression. With the chamber 20 closed and the skeins 50 under compression, the skeins are ready for treatment with a fluid agent such as a dye. The fluid agent enters the chamber 20 and comes into contact with the compressed skeins of yarn 50 through spray bars 22 which allow initial contact between the yarn and treating fluid to occur at a point within the chamber 20, remote or spaced from the defining walls of the enclosure 12 and within the bulk of the body of the compressed yarns. Introduction of the treating fluid at these specific sites is in part responsible for the uniform, non-patterned results obtained with the method and apparatus of the invention.

Figure 6:
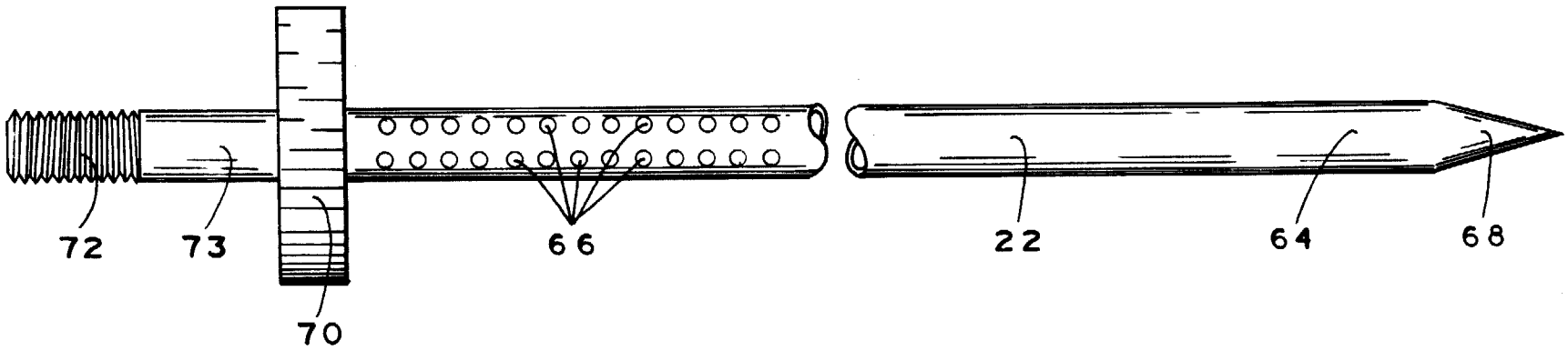
FIG. 6 is an isometric view of an embodiment component of the apparatus shown in FIG. 1 and identified as a "spray tube".

Referring now to FIG. 6, one can see further details of the spray bars 22. FIG. 6 is an isometric view of a typical spray bar 22. The spray bar 22 comprises a tubular body 64 having a plurality of apertures 66 therein. The plurality of apertures 66 are uniformly positioned along the length of the tubular body 64, below the position expected to be within the chamber 20 of enclosure 12 when closure 30 is in place. Preferably, spray bars 22 have cone-shaped ends 68 to facilitate and guide the spray bars 22 through apertures 34 in closure member 30 when the closure member 30 is urged toward the bottom of enclosure member 12 to compress the skeins 50 as shown in FIG. 5. Spray bars 22 also have threaded portions 72 to permit and facilitate their mounting with a nut (not shown) in the bottom of enclosure 12. Sealing grommets 70 seal the juncture between spray bars 22 and enclosure 12. End 73 of spray bar 22 may be adapted to mate with and complete a connection with hose supply lines 24 through which the fluid treating agent is carried to spray bar 22.

Figure 7:
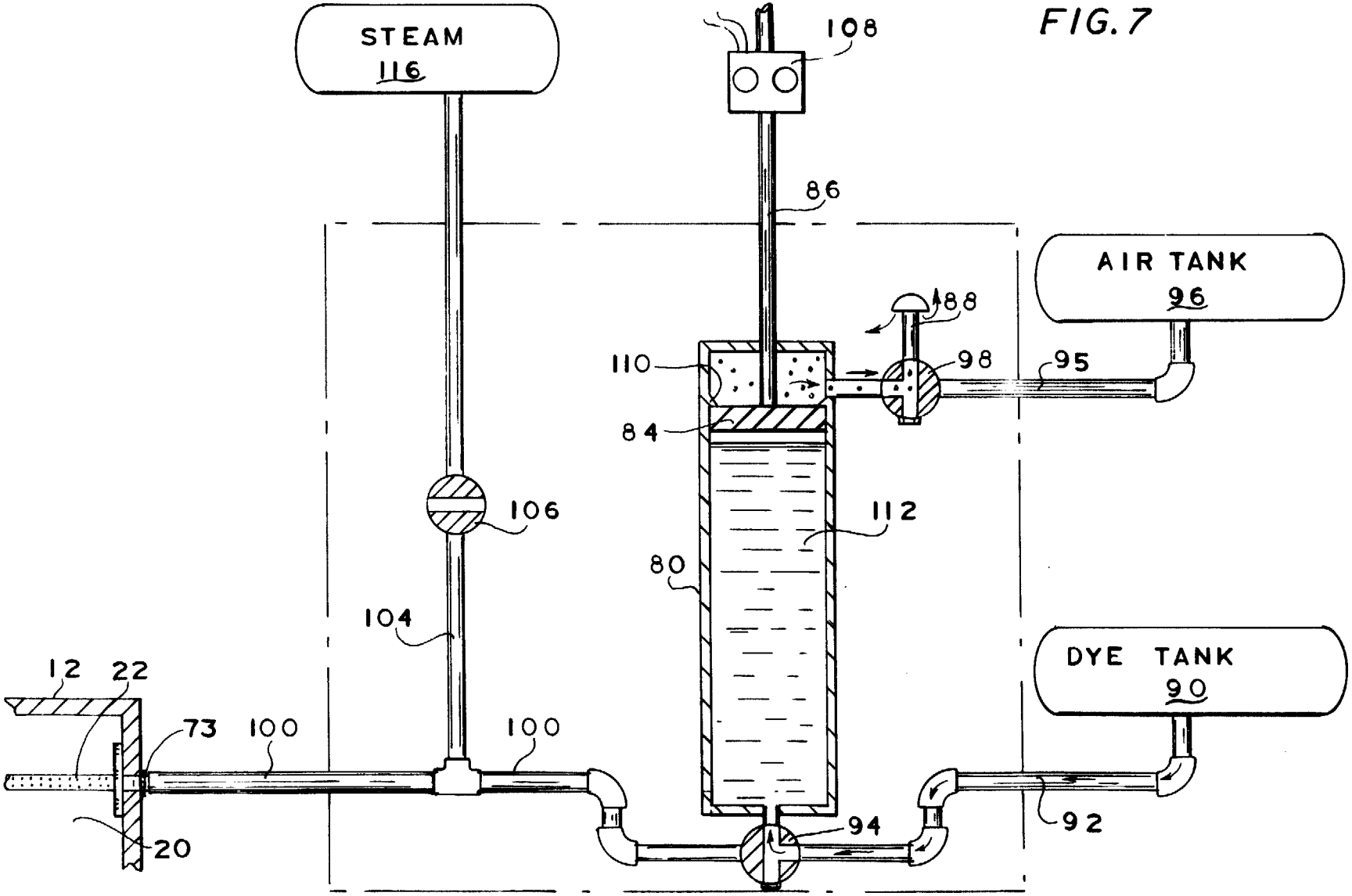
FIG. 7 is a schematic view of a fluid injection system associated with the embodiment apparatus shown in FIG. 1.

The yarn treating agent or agents are metered to contact the interior regions of the compressed skeins 50 through spray bars 22 as follows. Referring to FIG. 7, one may observe a schematic view of an embodiment metering system associated with the apparatus of FIG. 1. The metering apparatus comprises a metering cylinder 80 within which there is slidably mounted a barrier piston 84. A stem 86 is attached to barrier piston 84 and extends through the body wall of cylinder 80. The cylinder 80 is gas tight. A holding tank 90 is provided for holding the agent such as a dye to be applied to the yarns according to the method of the invention. The fluid treating agent 112 is carried from tank 90 to the lower end of cylinder 80 via conduit 92. The passage of the treating agent 112 through conduit 92 is controlled by three-way shuttle valve 94 which is shown open in FIG. 7 to allow filling of cylinder 80. At the upper end of cylinder 80 and on the opposite side of piston barrier 84, another conduit 95 leads into the cylinder 80. This conduit 95 is connected to a source 96 of inert gas such as air, nitrogen and the like. Flow of the inert gas through conduit 95 and into the upper reaches of cylinder 80 is controlled by three-way valve 98 which is shown closed to conduit 95 in FIG. 7. In FIG. 7, the treating agent 112 is filling cylinder 80, as shown by the arrows, forcing barrier 84 up. The gas above barrier 84 is being exhausted through the three-way valve 98 open to the vent 88. A rib 110 on the inner wall of cylinder 80 serves as a stop for the barrier-piston 84. An exiting conduit 100 leads away from the lower reaches of cylinder 80 and is attached to end 73 of a spray tube 22 (previously described). Flow of materials from cylinder 80 through conduit 100 are controlled by the three-way valve 94 (shown closed to conduit 100). Another conduit 104 leads into conduit 100 and is controlled by valve 106 (shown closed). Conduit 104 carries a heated fluid such as steam 116 into conduit 100. The operation of the metering apparatus is as follows. As shown in FIG. 7, a yarn treating agent 112 is flowing from holding tank 90 through conduit 92 and through the valve 94 into the lower portion of measuring cylinder 80. The pressure of the incoming agent 112 forces piston barrier 84 upward. While piston-barrier 84 is in its upward movement, three-way valve 98, permits gas above the piston-barrier 84 to vent to the atmosphere through vent 88. Compressed gases above piston-barrier 84 are vented through relief vent 88. An electrical switch 108 is in association with rod 86 so that when the piston-barrier 84 reaches its zenith at stops 110, switch 108 will be closed. Closure of the switch 108 can function to operate a series of solenoids, switching valve 94 to open conduit 100 and simultaneously close conduit 92. Additionally, valve 98 is switched to open conduit 95 and close vent 88, as shown in FIG. 8.

Figure 8:
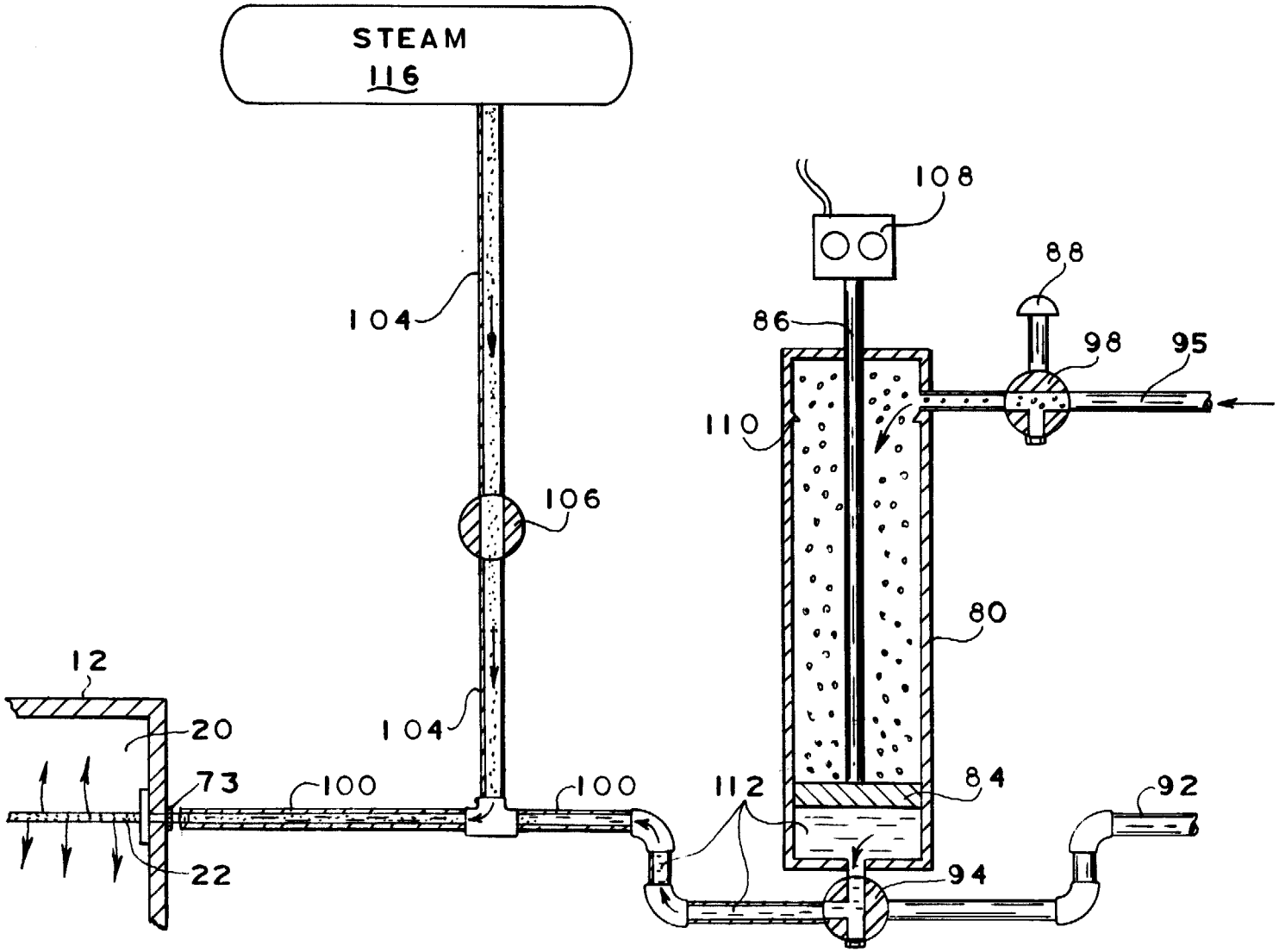
FIG. 8 is a view of a portion of the system shown in FIG. 7, during operation of the apparatus.

As shown in FIG. 8, a predetermined measure of treating agent 112 is now being delivered to the interior of chamber 20 through open conduit 100 and spray tube 22 as represented by the arrows. The agent 112 is displaced from cylinder 80 by descent of the piston-barrier 84. Piston-barrier 84 descends under the gas pressure on its upper surface from gas admitted to the upper confines of cylinder 80 through conduit 95 as shown in FIG. 8. The increase of pressure (gas in source 96 is maintained at a pressure above that for treating agent 112 supplied by tank 90), forces the piston-barrier 84 downward to displace treating agent 112 into the spray tube 22. In this manner, the treating agent 112 is sprayed at points distal to the interior walls of enclosure 12 and into the inner aspects of yarn bundles or skeins 50 which are compressed and filling the chamber 20 (not seen in FIG. 8). Only a predetermined measure of treating agent is so dispersed from each of the spray bars 22. Generally, the measure of treating agent 112 is such that only a relatively small area of the interior of a yarn bundle or skein 50 receives a single charge of treating agent from a given spray bar 22. Those skilled in the art will appreciate that the predetermined measure of treating fluid can be varied by varying the upward displacement permitted to the piston-barrier 84. That can be accomplished by conventional means to open and/or close the switch 108 at various times or mechanically with regard to the height of stem 86 as it rises. The sensing and electrical means for operating the system of FIGS. 7 and 8 is conventional and forms no part of this invention. In fact, the procedure may be carried out by manual manipulation of the various valves 94, 98 and 106 if so desired. In the system of FIGS. 7 and 8, stem 86, falling away from switch 108, allows the switch to open. Such can initiate via solenoids switching of the valve 98 to open vent 88. The valve 94 then closes by solenoid operation to isolate measuring cylinder 80 from spray tubes 22. With the closure of conduit 92 and cylinder 80, valve 106 may be opened so that a heated fluid such as steam may be introduced into conduit 100 from source 116. The steam or like heated fluid is delivered by spray tube 22 into the interior of the body of skeins 50 disposed in chamber 20 of enclosure 12. The heated fluid will serve to force penetration of the yarns by the treating agent and will set the treating agent 112 under heat and pressure. Alternatively, the valve 106 may be opened simultaneously with dispersion of the treating agent 112 into the skeins 50 to immediately admit the heated fluid such as steam. This is preferred since it allows for controlled penetration of the bundle of yarns and individual yarns by the treating agent. Following this, valve 106 may be closed, enclosure 12 opened by withdrawal of closure 30 and the treated bundles or skeins of yarn 50 removed. The entire procedure may then be repeated with a fresh loading of bundles or skeins 50, and usually may be carried out in cycles measured in minutes.

Those skilled in the art will appreciate that the same or a plurality of different treating agents may be directed into the skeins of yarn by adjacent spray tubes 22. Thus, for example, the spray tube 22 on one end of chamber 20 may disperse a first dye while simultaneously the spray tube 22 at the opposite end of chamber 20 disperse a second dye. The intermediate position spray tube 22 may deliver a third dye or may remain inoperative so that the skeins 50 will be space dyed. In this manner, random, unpatterned space dyeing of the yarn may be achieved. Variable spacings can be obtained by selection of rows of spray tubes 22 to be operated with a given shade of dye.

As stated previously, the invention also comprises a method of treating a textile with a fluid treating agent, which comprises providing the textile in the form of a loose bundle; compressing the bundle, introducing the agent initially at a site within the body of the compressed bundle under pressure; and decompressing the bundle. It will be seen from the above description of the apparatus 10 of the invention, that such is ideally suited for carrying out the method of the invention. Thus, the textile is provided in the form of a loose bundle, compressed in chamber 20 and receives the fluid treating agent into the inner aspects of the bundle body under pressure. By the method of the invention, any fluid treating agent may be employed to treat textiles. Representative of fluid treating agents are dyes, dye acceptance modifiers, resists,lubricants and like treating agents.

The method of the invention and the apparatus of the invention may be employed advantageously to treat a wide variety of textiles both natural and synthetic. For example, the method and apparatus of the invention may be employed to dye cottons, woolens, polyesters, polyamides, polyacrylics, polypropylene and like textiles. Those skilled in the art will appreciate that specific textiles may require specific formulations of dyes, resists and other fluid treating agents. However, the specific formulations suitable to specific classes of textiles are well-known and need not be given in detail herein. Any of the conventionally employed formulations such as a conventional dye formulation may be used for any given class of textile, in the apparatus and method of the invention. Conventional dye formulations and the textiles to which they may be applied and the general conditions of application are generally well-known to the art; see for example the Kirk-Othmer Encyclopedia of Chemical Technology, Second Edition, Vol. 7, pages 462–641.

As described above, the fluid treating agents are introduced under pressure into portions of the interior body of a textile bundle while it is under compression. Advantageously, bundles are compressed under weight of at least 5 to about 50 pounds per square inch. Lower compressions may not give the uniformity of results desired and higher compressions are generally not of any advantage. The proportion of the treating agent, measured and inserted into the compressed body of yarns is important for optimal efficiency. Advantageously the proportion will be that which can be absorbed completely in the predetermined area of the textile bundle adjacent the spray tube 22. By limiting the volume or quantity of treating agent which is infused into the interior of the yarn bundle, only a necessary portion of the bundle is treated. The optimum quantity to be infused into a given area of bundle site may be determined by trial and error and is dependent upon a number of diverse factors. Thus, the volume of steam used, introduces various quantities of condensed water on the textile surfaces, which may affect the absorptive capacity of the textile towards the treating agent depending on its natural moisture absorption qualities. As a further variable, certain textiles, for example nylon, will absorb higher quantities of moisture than will, for example, certain polyesters. The density of spray tube 22 for a given area are also a factor, the higher the density the lower the proportion of treating agent required per spray tube. As a general rule of thumb I have found that optimal proportions of dye solutions admitted to each of the spray tubes 22 in an embodiment apparatus of my invention, wherein the spray tubes are spaced approximately on the average of 1 tube for each 90 cubic inch of chamber space may be determined by the formula $$\left[\begin{array}{c}\text{Weight of}\\ \text{yarns (in}\\ \text{gms)}\end{array}\right] \times \left[\begin{array}{c}\text{Factor}\\ \text{A}\end{array}\right] = \begin{array}{l}\text{ml. of dye}\\ \text{solution per}\\ \text{spray tube}\end{array}$$

The factor A for polyesters has been determined by me on the basis of my experience to be about 0.55; for nylons 0.85 and for acrylics 0.75. These factors are optimal and may be varied from to a large degree. Trial and error procedures may be used to determine the limits of the factor for a given type of textile in a specific apparatus.

The pressure under which the treating agent is introduced into the bundle is not critical so long as it overcomes any pressure on the apertures 66 of the spray tubes 22 and effects penetration of the fluid treating agent into the mass of the bundles. Generally pressures of from about 5 to about 50 psig are useful.

Simultaneously with or following deposit of the chemical treating agent within the body of the bundle at a certain locale or site, a heated fluid is advantageously introduced at the same point or shortly thereafter to cause penetration of the textile fibers by the chemical treating agent. The heated fluid, at elevated temperature and pressure, causes the agent to penetrate both bundle and individual fibers within the bundle. Generally, an advantageous heated fluid for this purpose is steam, preferably under a pressure of 10 to 50 lbs. psig. After a time sufficient for penetration of the chemical treating agent to occur, the heated fluid under pressure may be cut off and the bundle decompressed. Generally the period of time is from about 15 seconds to about 3 or 4 minutes although longer periods may be used (without any particular advantage). The decompressed bundle may then be processed conventionally, i.e.; washed, dried, wound etc. as desired.

The following examples describe the manner and process of making and using the invention and set forth the best mode contemplated by the inventor of carrying out the invention, but are not to be construed as limiting.

The following examples were carried out using the above described apparatus of the invention wherein the enclosure component measured 20"×6" by 6" deep and having 8 spray tubes evenly distributed in 4 rows, each row having two spray tubes.

EXAMPLE 1

The apparatus of the invention is loaded as previously described with 750 gms of a polyester yarn (Kodel 5) in the form of skeins. The apparatus is rotated on its side, closed and the yarns compressed under a force of circa 18 lbs./sq. inch. Through each of the spray tubes in four rows of two spray tubes there is injected into the interior of the compressed skeins, under a pressure of 20 psig, 41 ml. of one of two different disperse dyes, prepared by mixing 5 gms of the dye in a mixture of 900 ml of 0.5 percent antimigrant Relzen D and 100 ml. of Dyblin P.

| Row | Dye | |
|---|---|---|
| 1 | Foron Yellow | SE-GLG* |
| 2 | Foron Yellow | SE-GLG* |
| 3 | Foron Blue | S-BGL* |
| 4 | Foron Blue | S-Bgl* |

*Sandoz Color and Chemical Manufacturing Co.

Simultaneously with injection of the dye solution, steam under a pressure of 20 psig is admitted to the spray tubes and maintained for 15 seconds after delivery of dye. At the end of this time, the steam is cut off, the apparatus is opened and the yarn removed. It is space dyed, with no visible pattern and no overlaps or "chevrons".

EXAMPLE 2

The apparatus of the invention is loaded as previously described with 800 gms of a nylon yarn (15 denier, 2.25 filaments per denier, 2 ply; Dupont). The yarns are formed in skeins. The apparatus is rotated on its side, closed and the yarns compressed under a force of circa 18 lbs./square inch. Through each of the spray tubes in each of the 4 rows of 2 spray tubes there is injected under a pressure of 10 psig into the interior of the compressed yarns, 68 ml of 4 different dyes prepared by dissolving 2.5 gms of the dye in 850 ml of water (pH 8.5).

| Row | Dye |
|---|---|
| 1 | Telon Black PC |
| 2 | Telon Red Fl |
| 3 | Telon Fast Blue GGN |

-continued

| Row | Dye |
|---|---|
| 4 | Telon Yellow 2G |

Following injection of the dyes, steam is admitted to the spray tubes for 1 minute at a pressure of 10 psig. At the end of this period, steam is cut off and the apparatus opened. The yarns are observed to be space dyed with a high degree of even, uniform penetration. There are no overlaps or "chevrons".

EXAMPLE 3

The apparatus of the invention is loaded as previously described with 600 gms of an acrylic yarn in the form of skeins. The apparatus is rotated on its side, closed and the yarns compressed under a force of 18 lbs./square inch. Through each spray tube of the 4 rows of 2 spray tubes there is injected into the interior of the compressed skeins, under a pressure of 20 psig, 45 ml of Sevvon Yellow 8GMF (prepared by dissolving 10 gms of the dye in 1000 ml of water and adjusting the pH to 4). The dye is delivered over a period of 30 seconds simultaneously with steam under a pressure of 20 psig. The steam is continued for an additional 30 seconds. At the end of this period, steam is cut off and the apparatus opened. The yarn is seen to be a solid dyed yarn, evenly and uniformly dyed.

EXAMPLE 4

The apparatus of the invention is loaded as previously described with 800 gms of a polyester (Kodel Poly 244, Dupont). The yarns are in the form of skeins. The apparatus is rotated on its side, closed and the yarns compressed under a force of circa 10 lbs./square inch. Through each of the (8) spray tubes there is injected 88 ml of a dye solution comprising 2.5 gms of Foron Yellow SE-GLG (Sandoz, supra), 400 ml of water and 60 ml of a mixture of 900 ml of 0.5 percent anti-migrant Relzen D, and 100 ml of Dyblin P. The injection is under a pressure of 20 psig over a period of 15 seconds, simultaneously with steam (20 psig). At the end of the injection, steam is continued for an additional 30 seconds. At the end of this period, steam is cut off and the apparatus opened to observe a uniformly solid dyed yarn.

Figure 9:
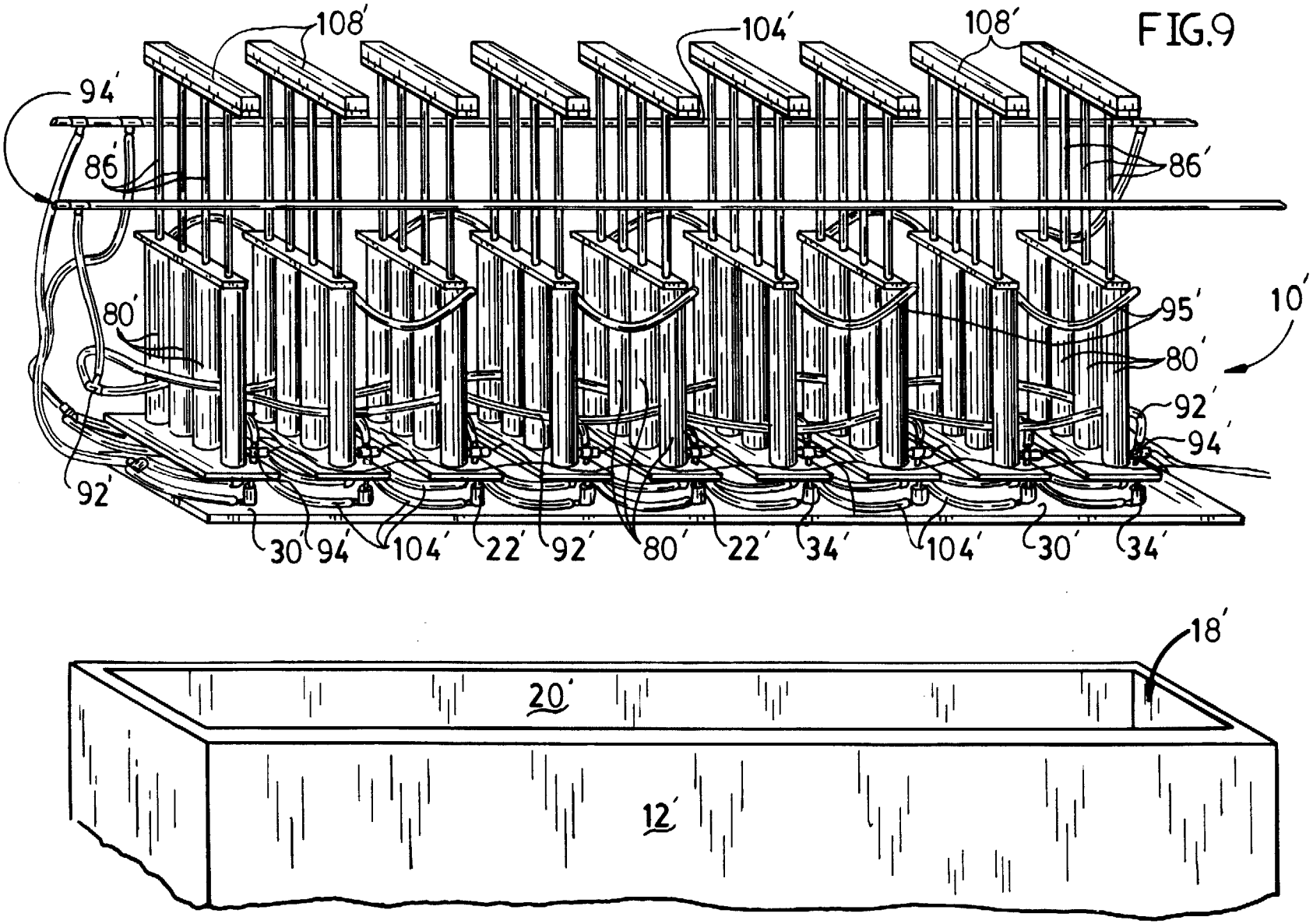
FIG. 9 is a view-in-perspective of another embodiment apparatus of the invention shown open.

FIG. 9 is a view in perspective of a part of another embodiment apparatus of the invention, shown in an open position. In the apparatus 10' shown in FIGS. 9–16, parts somewhat analogous to those of the above described apparatus 10 are identified by the same digital number, with the addition of a prime symbol.

The apparatus 10' for the treatment of skeins with fluid agents comprises an open box-like enclosure 12' having an open upper end 18' leading into an interior treating chamber 20'. A closure member 30' is of a dimension adaptable to slide into the chamber 20' and to close the open end 18' of box 12'. It will be seen that the volume of chamber 20' can be varied, depending on the final position of closure 30' after it passes into chamber 20' through the open end 18'. The closure 30' is mounted in a stationary position (support members not shown in FIG. 9) and closes the open end 18' when box 12' is raised to meet closure 30'. The closure 30' is pierced by a plurality of apertures 34' which receives the lower ends of multiple injection probes 22'. Injection probes 22' extend through apertures 34' a short distance so that when box 12' is raised to meet closure 30' and to close open end 18' of box 12', the nozzle ends 68' of the probes 22' are positioned at points within treatment chamber 20' a spaced distance from the member 30' and from the walls of box 12'. The nozzle ends 68' of injection probes 22' are seen protruding beneath closure 30', in FIG. 10. Continuing to refer to FIG. 9, it can be seen that mounted on the upper surface of closure member 30' are a plurality of metering cylinders 80'. However, it will be appreciated that the metering cylinders 80' may be independently situated, free of the closure member 30' and remotely situated in respect thereto. The metering cylinders 80' are in fluid communication with the injection probes 22' through an intermediate shuttle valve 94' and connecting conduits. A conduit 92' delivers dye or other textile treating fluids through the shuttle valve 94' to measuring cylinder 80'. The measuring cylinder 80' dispenses the dye or treating fluid through shuttle valve 94' to injection probe 22' when compressed inert gas or air is delivered to the top of measuring cylinder 80' through gas conduit 95'. A steam line 104' delivers wet steam to an annular nozzle 23' on appropriate signal as will be described more fully hereinafter. The nozzle 23' circumscribes the nozzle 68' of injection probe 22' and also passes through the aperture 34' as shown more clearly in FIG. 14 and FIG. 15.

Figure 10:
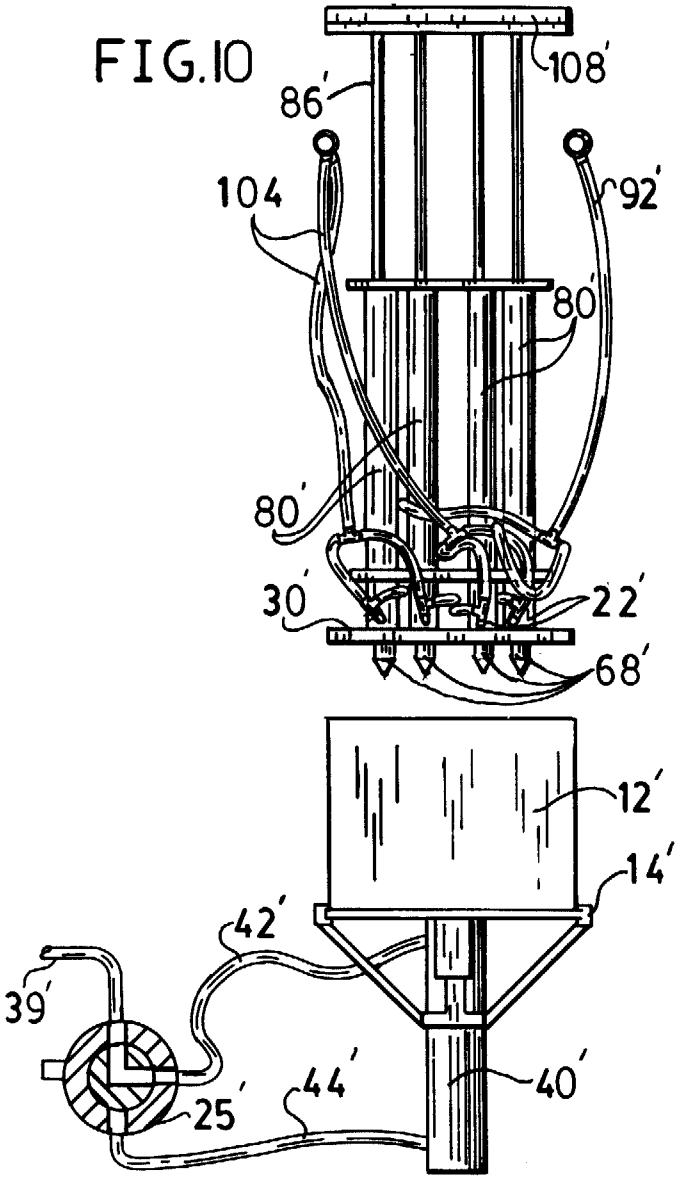
FIG. 10 is an end elevation of the apparatus of FIG. 9.

FIG. 10 is an end elevation of the apparatus shown in FIG. 9 and shows further details of the apparatus 10'. The box 12' is slidably mounted on tray 14' so that it may be positioned beneath and withdrawn from under closure 30' at will, for convenience in loading and unloading the treatment chamber 20' with textile skeins 50' for treatment. The support tray 14' is mounted on ram 38' (see FIG. 11) which is movably actuated vertically by pneumatic piston 40'. Inert gas or air supply line 44' and inert gas or air exhaust line 42' service piston 40' to effect a raising and lowering of the box 12' under closure 30', to close or open the open end 18' of box 12'. A 4-way gas pressure valve 25' (see FIGS. 10 and 11) permits insertion and withdrawal of the gas from the piston 40'. A pressure regulator on gas supply line 39' (not shown) assures a constant pressure of the ram on box 12' when the piston is activated.

Figure 11:
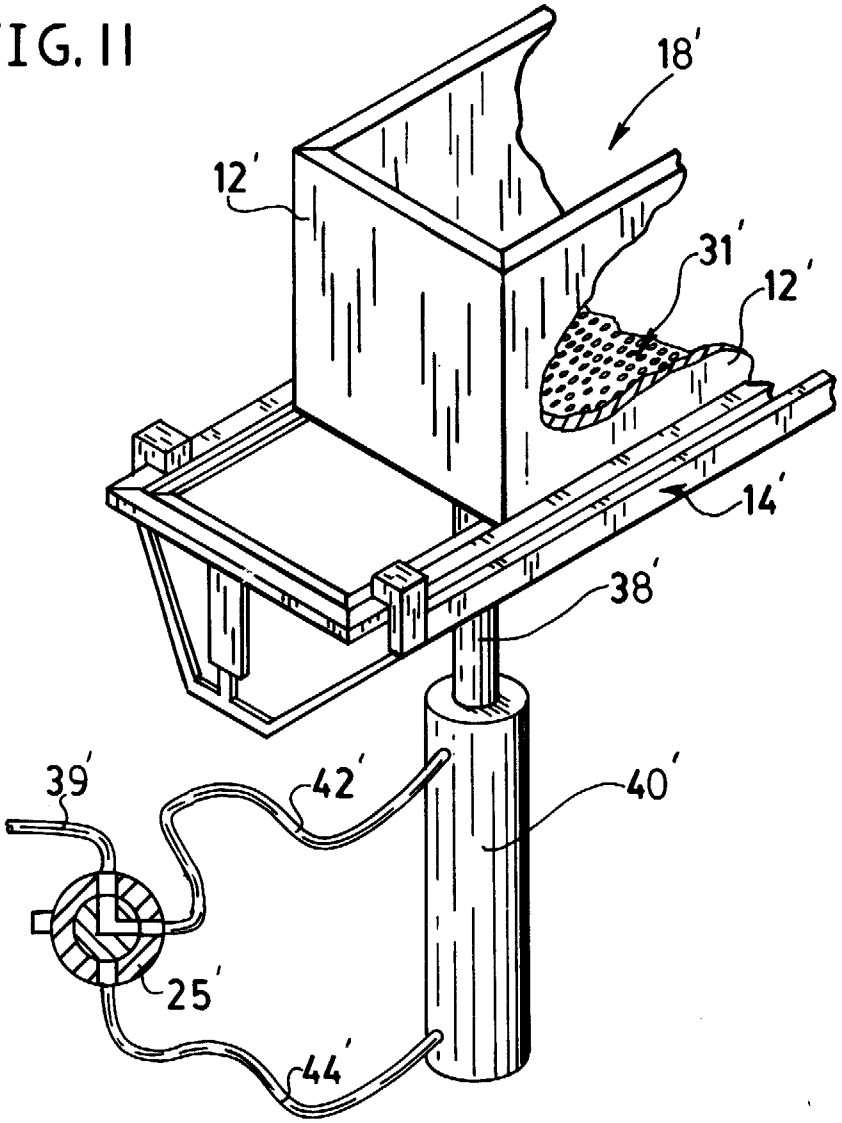
FIG. 11 is a view-in-part of the lower component of the apparatus of FIGS. 9 and 10.

FIG. 11 is a view in part of the lower component box 12' of the apparatus 10' and shows that the lower floor of box 12' is perforated for drainage and ventilation with perforations or vents 31'.

Figure 12:
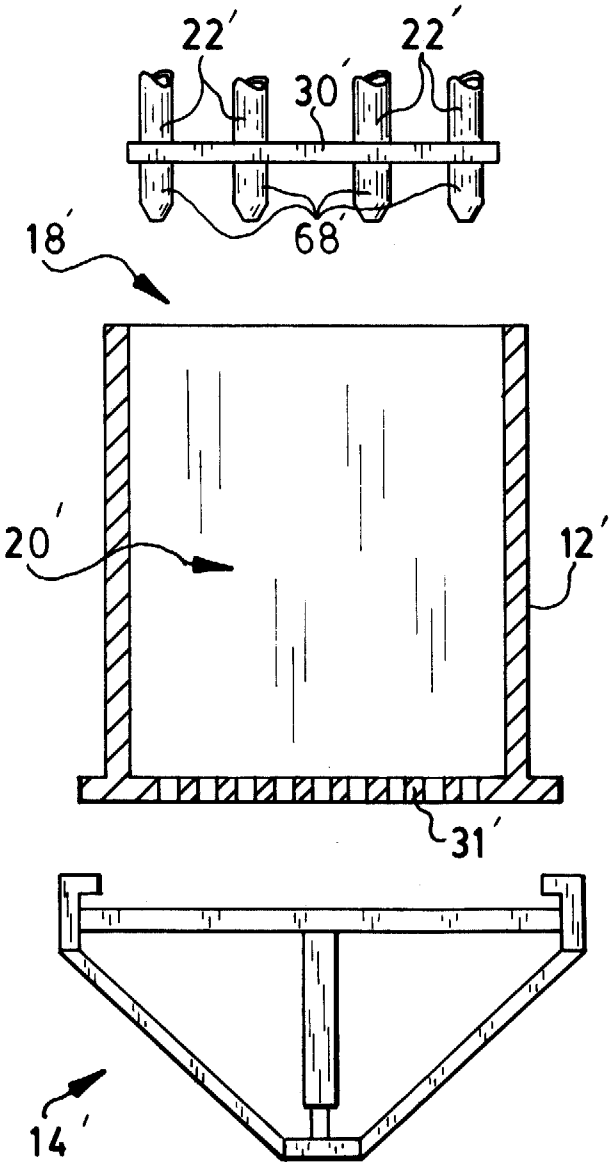
FIG. 12 is a cross-sectional side elevation-in-part of the apparatus of FIG. 9.

Referring to FIG. 12, a cross-sectional side elevation in part of the apparatus 10', further details of the construction of apparatus 10' may be observed.

In operation, the box 12' is filled at least partially with textile skeins 50' to be treated with a fluid treating agent. The following discussion will be directed towards a fabric dye as the treating agent, but it will be appreciated that such is for illustrative purposes only. The textile skeins, such as carpet yarns in the form of skein bundle is disposed loosely in the box 12', preferably substantially in yarn axial alignment with the lengthwise axis of box 12'. When the box 12' is filled at least partially it is positioned beneath the stationary closure member 30', sliding on tray 14'. When the box 12' is aligned properly to mate with closure 30', the operator then starts a program timer 61' (see FIG. 17) by activating a start switch. The timer 61' begins rotating and at a first signal position, activates a solenoid for valve 25' which then switches compressed gas flow in gas conduit 39' to gas conduit 44' (the valve 25' is referred to as the "head valve" in FIG. 17). Piston 40 then serves to move ram 38' upward, thereby raising tray 14' and supported box 12' so as to force box 12' toward and past closure member 30' to close opening 18' and allow closure 30' to compress textile skeins 50' disposed in chamber 20'. Compression of the skein to be dyed eliminates air pockets in the skein bundles and has a beneficial effect on the dyeing process itself.

Figure 16:
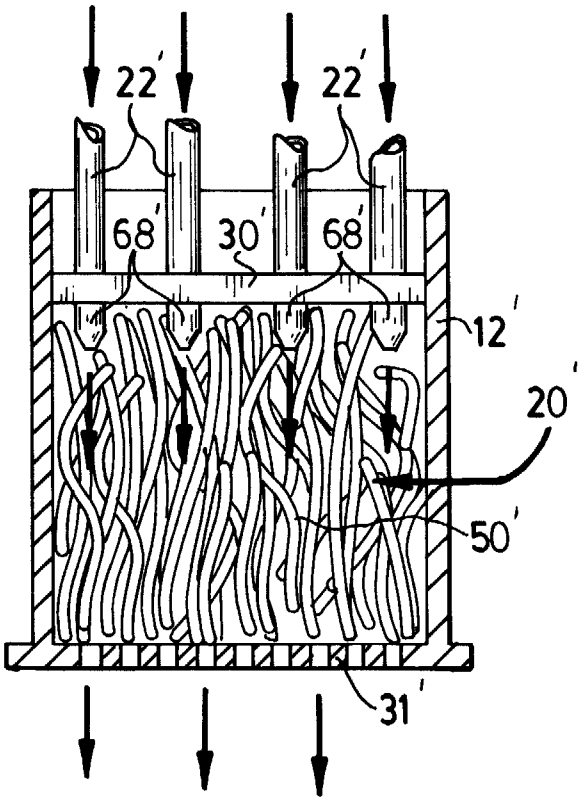
FIG. 16 is a view similar to FIG. 12, but during operation of the apparatus of FIG. 9.
Figures 13, 14, 15:
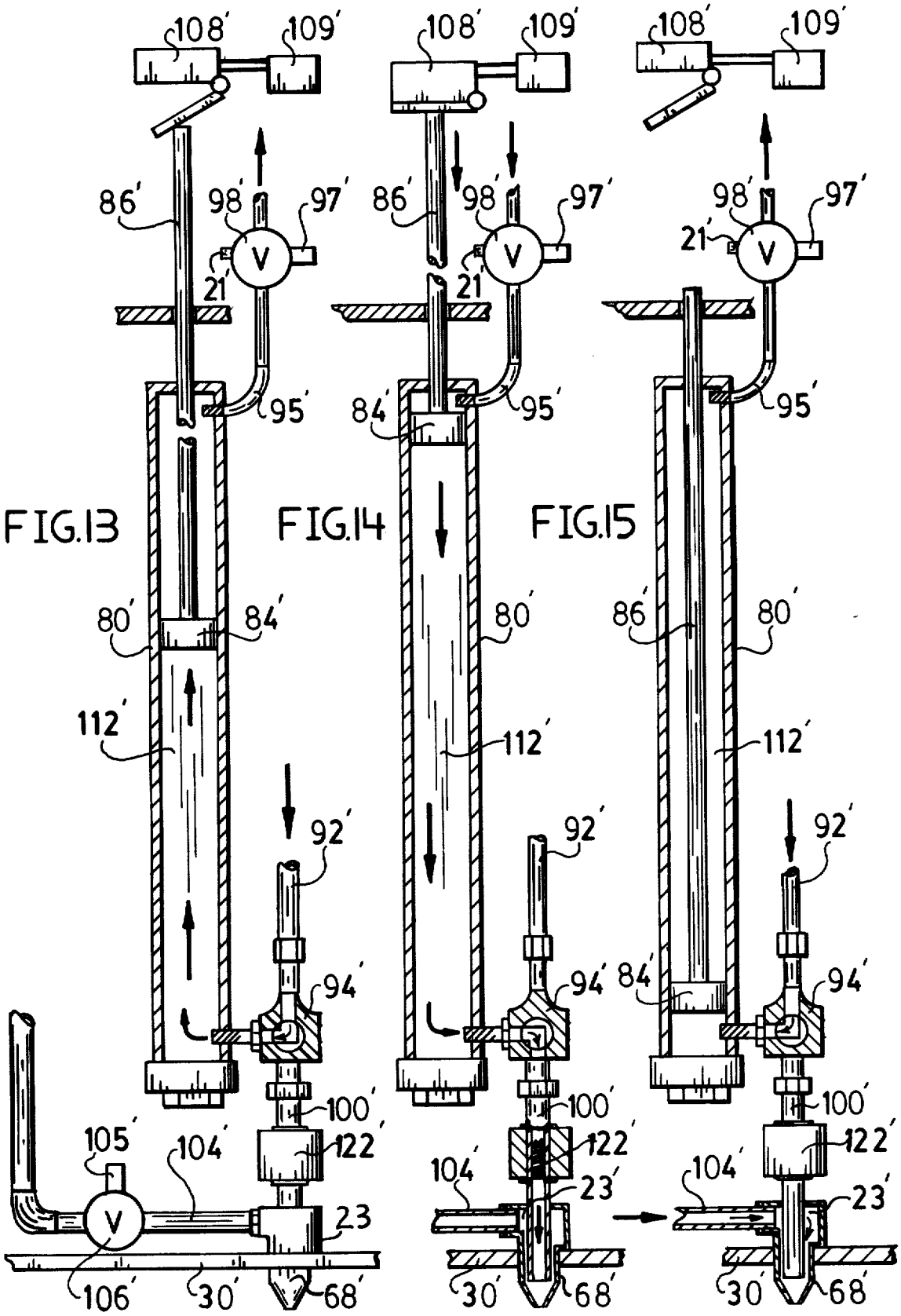
FIGS. 13–15, inclusive, are side elevations of one of the dye injector components of the apparatus of FIG. 9, in different stages of the operating cycle.
Figure 17:
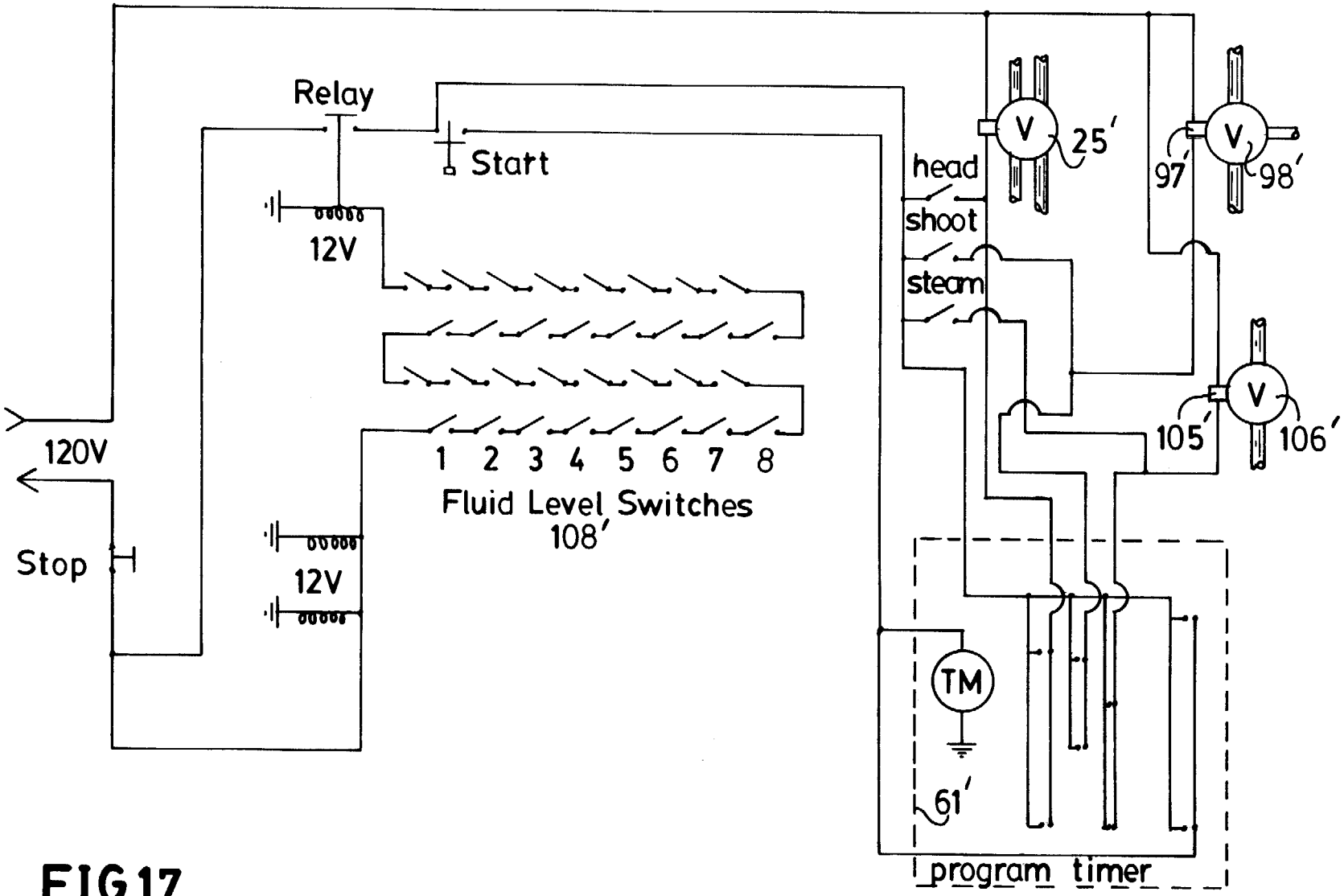
FIG. 17 is a diagram of an embodiment electrical circuit for controlling automatically the operation of the apparatus of FIG. 9.

Referring now to FIG. 16, one can see chamber 20' closed by member 30' and the compressed textile yarns 50' within chamber 20' of box 12'. After a time lapse programmed by timer 61', (see FIG. 17) valve 98' is opened which allows compressed inert gas or air to travel through conduit 95', and to apply force against the piston 84'; see FIG. 14. As shown in FIG. 14, measuring cylinder 80' is filled with dye 112'. The force then is carried by dye liquid 112' to shuttle valve 94' which switches under the increased pressure in cylinder 80' so as to put the dye 112' contents of measuring cylinder 80' in fluid communication with injection probe 22'. Thus, piston 84' forces the dye 112' contents of measuring cylinder 80' through the injection probes 22' and into the interior body of compressed yarns 50' as shown in FIG. 16. The inserted contents of measuring cylinder 80' are generally carried towards vents 31', and are dispersed in the textiles 50' immediately adjacent nozzles 68', forming a "puddle" of dye which does not extend completely through the compressed skein bundle. It should be noted here, that if the dye is not deposited in this "puddle" within the compressed skein body, i.e.; if it were deposited on an outer surface of the bundle, a uniform and high quality dyed product may not be obtained. The timer 61' after allowing time for expulsion of dye 112' from measuring cylinder 80' will de-energize the solenoid 97' to switch valve 98' so the compressed gas can escape from cylinder 80' through conduit 95' and out exhaust vent 21' of valve 98' (see FIG. 15). The pressure of dye in conduit 92' then becoming greater than the pressure in cylinder 80', switches shuttle valve 94' so that dye 112' will flow from conduit 92' to cylinder 80' and refill the cylinder 80' with the dye for the next "shot", as shown in FIG. 13. When cylinder 80' is filled, rod 86' closes switch 108' to terminate the cycle. The timer further signals solenoid 105' (see FIG. 13) to open valve 106'. This allows the injection of steam from steam line 104' into the chamber 20' through the annular steam nozzle 23'. The effect of following injection of dye 112' with steam is to disperse and carry the dye for penetration throughout the textile 50' while also setting the dye. A check valve 122' prevents backflow of the pressurized steam into conduit 100' and into cylinder 80'. It should be noted that the wet steam is delivered at the site of the dye "puddle" deposited, and in fact at the center of the puddle. This is important to obtain proper dispersion of the dye. If steam is directed to the periphery of the deposited "puddle", a uniform dispersion of the dye will not occur, resulting in non-dyed areas. The timer, after an appropriate and preset time, then signals solenoid 105' to close valve 106'. Solenoid 97' is then signalled to switch valve 98' to close communication between measuring cylinder 80' and the inert gas supply conduit 95' as previously described. The ram 38' withdraws to move downward and open the box 12' for access to the now dyed textile 50'. Pulling box 12' out of alignment with closure 30' readies it for emptying. The apparatus 10', after unloading is then ready for a repeat cycle. It will be appreciated that the cycles can be carried out automatically and the boxes of material can be fed through the apparatus automatically.

It will also be appreciated that an important factor in the method of the invention resides in the compression of the skein bundle during the steaming step when dyeing. This is essential. The apparatus 10' of the invention is particularly adapted to maintain this compression, even if the skeins should shrink to any extent upon exposure to the steam. By employing a constant pressure, pneumatic piston 40' with a regulator set for any desired compression force, upon shrinkage of the skein and loss of volume, the ram 38' is urged further upward against the closure 30' to compensate for the shrinkage.

In regard to the filling of the measuring cylinders 80' with dye as described above, the volume of dye 112' filling measuring cylinder 80' may be predetermined and varied by adjustment as described for apparatus 10. Also it should be noted that when switch 108' is closed, an electrical circuit is closed to indicate that the particular measuring device is ready. The apparatus 10' will not function to start a cycle until all switches 108' are closed.

The electrical circuitry for the above described embodiment apparatus 10' as described above is shown in FIG. 17 of the accompanying drawings. The switch identified "head" closes the circuit to valve 25' to operate piston 40'. The switch labeled "shoot" closes the circuit for operation of valves 98' and 106' and in effect "shoots" the dye or other treating agent into the injection probe 22'. The switch identified "steam" activates the means of opening valve 106' to insert wet steam as described above.

The apparatus 10' can be operated in a manner similar to apparatus 10, to space dye skeins of yarns and the like. That is, by providing a dye of one color to certain injection probes 22' and dyes of different color to adjacent probes 22', one can carry out space-dyeing of the compressed textile. By limiting the proportions of dye delivered to the individual probes 22' to that proportion which can be fully absorbed by the skein in the vicinity below the nozzles 68', there is minimal waste of dye or creation of waste water, pollution problems. The circulation and maintenance of large heated, volumes of dye for recirculation as generally required in the prior art is avoided.

What is claimed is:

1. Apparatus for the treatment of skeins of yarns with a fluid, which comprises;

an enclosure having a wall defining an interior treatment chamber for receiving the skeins and having an opening therein providing access to the chamber;

a removable closure for the opening;

means associated with the enclosure for compressing skeins received in the treatment chamber, within a compression zone of the chamber;

conduit means having a first open end outside of the enclosure and a second open end at a point within the compression zone and spaced from the enclosure wall;

means for metering and delivery of treating fluid through the second open end of the conduit means, to a site within the body of the compressed skeins in a proportion which will be fully absorbed in a predetermined area of the skeins compressed in the chamber; and means for delivery of wet steam to the site, following deposition of treating fluid thereat.

2. The apparatus of claim 1 wherein said means for compressing comprises said closure.

3. The apparatus of claim 1 wherein said means for metering comprises a metering cylinder.

4. Apparatus for the space-dyeing of textile yarn bundles, which comprises;

an enclosure having an opening therein and sidewalls and a bottom wall which partially defines a dyeing chamber;

a removable closure member which when emplaced in the opening closes said chamber and forms a top wall of said dyeing chamber;

means for moving said closure and said enclosure in relation to each other to reduce the volume of the chamber;

a plurality of conduits passing through the chamber walls and providing fluid communication between said chamber and the outside of said enclosure, said conduits opening within said chamber at a point spaced from the defining walls of said chamber;

means attached to that portion of said conduits outside of said enclosure for metering and introducing a predetermined measure of said fluid into said conduits in a proportion which will be fully absorbed in a predetermined area of textile disposed in the closed chamber; and means associated with the conduits for delivery of wet steam at said point.

5. The apparatus of claim 4 wherein said means for introducing a predetermined measure of said fluid comprises a measuring cylinder, means for filling said measuring cylinder with said fluid, pipe means connected to said conduits and means for forcing said fluid from said cylinder to said conduits.

6. The apparatus of claim 1 wherein the means for delivery of wet steam comprises a pipe having a first end outside of the enclosure for receiving the wet steam and a second, nozzle end for delivery of the steam, said nozzle being an annular nozzle circumscribing the second open end of the conduit means.

7. The apparatus of claim 4 wherein said means for moving comprises a ram connected to the removable closure member and adapted to move the closure member into the dyeing chamber through the opening.

8. The apparatus of claim 4 wherein said means for moving comprises a ram connected to the enclosure and adapted to move the enclosure into association with the closure, whereby the closure closes the dyeing chamber.

9. The apparatus of claim 4 wherein the means associated with the conduits for delivery of wet steam comprise a plurality of pipes each having a first end outside of the enclosure for receiving the wet steam and a second, nozzle end for delivery of the wet steam, said nozzle being an annular nozzle circumscribing the associated conduit at the point spaced from the defining walls of the chamber.

* * * * *